US006863987B2

(12) United States Patent
Kaneko et al.

(10) Patent No.: US 6,863,987 B2
(45) Date of Patent: Mar. 8, 2005

(54) TITANIUM RESISTANT TO DISCOLORATION IN ATMOSPHERIC ENVIRONMENT AND PROCESS OF PRODUCTION OF SAME

(75) Inventors: Michio Kaneko, Futtsu (JP); Teruhiko Hayashi, Hikari (JP); Kazuhiro Takahashi, Hikari (JP); Kiyonori Tokuno, Tokyo (JP); Junichi Tamenari, Hikari (JP); Kinichi Kimura, Tokyo (JP); Hiroshi Shimizu, Tokyo (JP); Shoichi Maruyama, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 277 days.

(21) Appl. No.: 10/220,030

(22) PCT Filed: Feb. 23, 2001

(86) PCT No.: PCT/JP01/01385

§ 371 (c)(1),
(2), (4) Date: Nov. 21, 2002

(87) PCT Pub. No.: WO01/62999

PCT Pub. Date: Aug. 30, 2001

(65) Prior Publication Data

US 2003/0168133 A1 Sep. 11, 2003

(30) Foreign Application Priority Data

Feb. 23, 2000 (JP) ..... 2000-046627
Apr. 27, 2000 (JP) ..... 2000-128500
Jan. 19, 2001 (JP) ..... 2001-011149

(51) Int. Cl.[7] ..... B32B 15/04; C22F 1/18

(52) U.S. Cl. ..... 428/472.1; 148/669; 148/670; 148/421; 205/322; 205/333; 420/417; 428/926

(58) Field of Search ..... 428/472.1, 926; 148/669, 670, 421; 205/322, 333; 420/417

(56) References Cited

U.S. PATENT DOCUMENTS 5,554,235 A 9/1996 Noe et al. ..... 148/610

FOREIGN PATENT DOCUMENTS

| | | |
|---|---|---|
| JP | 60-238465 | 11/1985 |
| JP | 62-86197 | 4/1987 |
| JP | 62-284056 | 12/1987 |
| JP | 1-234551 | 9/1989 |
| JP | 6-173083 | 6/1994 |
| JP | 2000-1729 | 1/2000 |

*Primary Examiner*—Robert R. Koehler
(74) *Attorney, Agent, or Firm*—Kenyon & Kenyon

(57) ABSTRACT

Titanium resistant to discoloration in an atmospheric environment characterized by having an average carbon concentration of 14 at % or less in a range to a depth of 100 nm from the surface and having an oxide film of a thickness of 12 to 40 nm at its surface. Titanium resistant to discoloration in an atmospheric environment characterized in that, in X-ray diffraction of its surface, a ratio (X1/X2) of a (200) peak intensity X1 of TiC to a (110) peak intensity X2 of titanium is not more than 0.18 and by having an oxide film of a thickness of 12 to 40 nm at its surface.

16 Claims, 2 Drawing Sheets

TITANIUM RESISTANT TO DISCOLORATION IN ATMOSPHERIC ENVIRONMENT AND PROCESS OF PRODUCTION OF SAME

TECHNICAL FIELD

The present invention relates to titanium resistant to discoloration in an atmospheric environment when used for outdoor applications (roofing, walls, etc.) and a process of production of the same.

BACKGROUND ART

Titanium exhibits an extremely superior corrosion resistance in an atmospheric environment, so is being used for building material applications like roofing and walls in seashore regions. It has been more than a decade since titanium began to be used for roofing materials etc., but up until now there have been no examples reported of the occurrence of corrosion. Depending on the environment of use, however, sometimes the surface of the titanium used changes to a dark gold color over a long period of time. The discoloration is limited to the surface layer, so the anticorrosive function of the titanium is not impaired, but this is sometimes a problem from the viewpoint of the aesthetic appearance. To eliminate discoloration, the titanium surface has to be wiped with a mixed acid of nitric acid and fluoric acid, or another acid or else be lightly polished by polishing paper or a polishing agent to remove the discolored portion. When treating a large area of titanium on the surface such as with roofing, this is a problem from the viewpoint of the work efficiency.

The reasons for the occurrence of discoloration in titanium have still not been fully elucidated, but there are cases where it occurs due to Fe, C, $SiO_2$, and the like floating in the air and depositing on the titanium surface and suggestions of the possibility of occurrence due to the increase in thickness of titanium oxide on the titanium surface. Further, as a method for lessening discoloration, as disclosed in Japanese Unexamined Patent Publication (Kokai) No. 2000-1729, it has been reported to be effective to use titanium having an oxide film of not more than 100 angstroms on the titanium surface and reduced in surface carbon concentration to not more than 30 at %.

For the purpose of the prevention of discoloration, the inventors, however, conducted surface analyses of roofing materials made of titanium where discoloration had occurred at various parts of Japan and discoloration promotion tests to carefully study the effects of the thickness of the oxide film and surface carbon concentration on discoloration. As a result, they found that discoloration was not sufficiently prevented even by the invention disclosed in Japanese Unexamined Patent Publication (Kokai) No. 2000-1729 and that there has not been any means up to now for fundamentally solving the problem of discoloration occurring in titanium used in an atmospheric environment.

DISCLOSURE OF INVENTION

The present invention has as its object to provide titanium resistant to discoloration in an atmospheric environment and a process for the production of the same which prevent discoloration from occurring when using titanium in an atmospheric environment such as roofing or wall materials and which eliminate a drop in the aesthetic appearance over a long period of time.

The inventors conducted surface analysis of titanium roofing materials where discoloration had occurred at various parts of Japan and discoloration promotion tests to carefully study the effects of the composition of the titanium surface on discoloration and as a result discovered that discoloration of titanium is promoted by the concentration of carbon at the titanium surface or the presence of titanium carbides, titanium carbonitrides, and titanium nitrides. Further, they discovered that forming a relatively thick oxide film on the surface worked effectively to improve the discoloration resistance.

The present invention was perfected based on this discovery and has as its gist the following:

(1) Titanium resistant to discoloration in an atmospheric environment characterized by having an average carbon concentration in a range to a depth of 100 nm from an outermost surface of not more than 14 at % and having an oxide film of a thickness of 12 to 40 nm at the outermost surface.

(2) Titanium resistant to discoloration in an atmospheric environment characterized in that, in x-ray diffraction of its surface, a ratio (X1/X2) of a (200) peak intensity X1 of TiC to a (110) peak intensity X2 of titanium is not more than 0.18 and by having an oxide film of a thickness of 12 to 40 nm at its outermost surface.

(3) Titanium as set forth in (1) or (2), characterized by having an oxide film causing an interference color at its surface.

(4) A process of production of titanium resistant to discoloration in an atmospheric environment as set forth in (1) or (2), characterized by cold rolling the titanium, then annealing it in vacuum or an inert gas, then suitably thereafter mechanically or chemically removing at least 1 $\mu$m of the titanium surface.

(5) A process of production of titanium resistant to discoloration in an atmospheric environment as set forth in (1) or (2), characterized by cold rolling the titanium, then mechanically or chemically removing at least 0.5 $\mu$m of the surface, then suitably thereafter annealing in vacuum or an inert gas.

(6) A process of production of titanium resistant to discoloration in an atmospheric environment of (1) or (2), characterized by cold rolling the titanium, then electrolytically cleaning it in a pH 11 to 15 alkali solution in a range of current density of 0.05 to 5A/cm$^2$, then suitably thereafter annealing in vacuum or an inert gas.

(7) A process of production of titanium resistant to discoloration in an atmospheric environment as set forth in (3) as set forth in any one of (4) to (6), characterized by further performing, as after-treatment, treatment for anodically oxidizing the surface in an electrolyte solution or heating it to oxidize in the atmosphere.

(8) A process of production of titanium resistant to discoloration in an atmospheric environment as set forth in any one of (1) to (3) as set forth in any one of (4) to (7), characterized by further performing steam treatment for bringing the surface into contact with 100 to 550° C. steam for 10 seconds to 60 minutes at least once.

(9) A process of production of titanium resistant to discoloration in an atmospheric environment as set forth in any one of (1) to (3) as set forth in (8), characterized in that said steam treatment is performed as a final step in the production process.

BEST MODE FOR CARRYING OUT THE INVENTION

While using the general term "atmospheric environment", the environment completely differs depending on the region such as at the seashore, industrial belts, and the countryside. The environmental factors causing discoloration of titanium probably differ as well. Further, even in the same region, there is titanium which discolors and titanium which is resistant to discoloration. There may therefore be a possibility of effects due to component elements in the titanium or differences in the production process.

The inventors worked to elucidate such effects of the environment and material factors on the discoloration of titanium by selecting regions of different environments around Japan and conducting tests exposing titanium given various types of finishing treatments and by removing titanium roofing which had actually discolored and analyzing the titanium surface.

Figure 1:
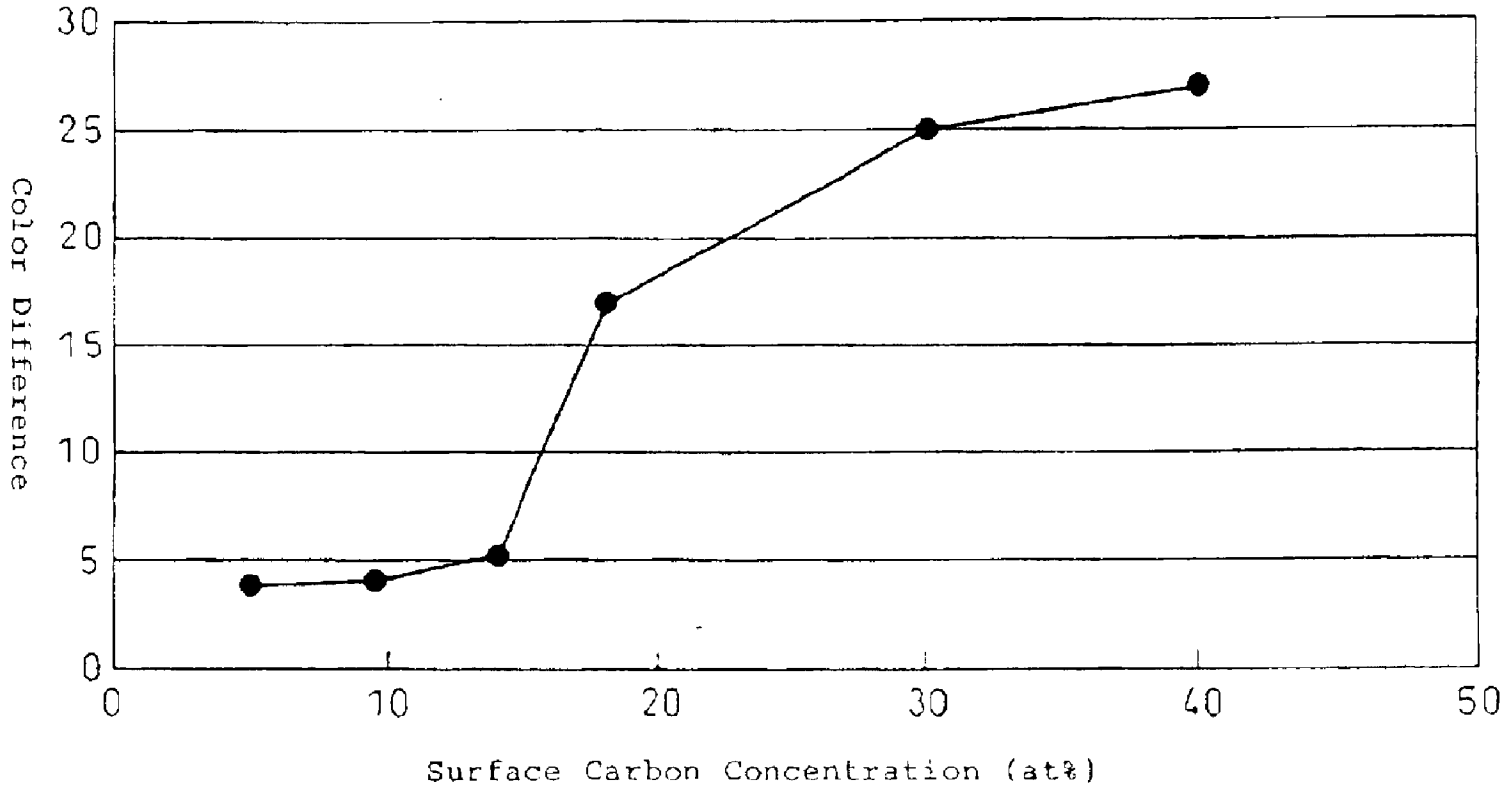
FIG. 1 is a graph of the effect of the surface carbon concentration on the color difference.

As a result of such continued studies, as shown in FIG. 1, they discovered that titanium discolored more easily the higher the concentration of carbon at the titanium surface. FIG. 1 shows the relationship between the results of measurement of the color difference before and after a four-year exposure test conducted on titanium sheet in Okinawa and the average amount of carbon in a range to 100 nm from the titanium surface measured using an Auger electron spectroscopy. Further, as environment factors promoting discoloration, they found that acid rain had a large effect.

In the present invention, as shown by the above (1), the concentration of carbon at the titanium surface is defined. The carbon present at the titanium surface is believed to increase the rate of dissolution of titanium when titanium is used in an atmospheric environment and as a result increase the thickness of the titanium oxide at the titanium surface, cause interference color, and cause coloring. For the amount of carbon, as shown in FIG. 1, the occurrence of discoloration is suppressed in a region of the amount of carbon in a range to 100 nm from the outermost surface of not more than 14 at %, so the concentration of carbon has to be reduced to not more than 14 at %.

The solid solution limit of carbon in titanium is about 1 at % at 700° C. So long as not dissolving the titanium under pressure, an amount of carbon promoting discoloration will not penetrate into the titanium. Carbon penetrates titanium for example during cold rolling when the rolling oil breaks down and penetrates the titanium surface and in the case or annealing or vacuum annealing and when carbon penetrates the surface layer of the titanium due to ion sputtering, an accelerator, vapor deposition, electrodischarge machining, etc.

In these cases, if the penetration of the carbon into the titanium surface is limited to the extreme surface layer, there would not be enough of an effect to promote discoloration. That is, if the depth of penetration of titanium into the titanium surface is limited to the extreme surface layer (for example, less than 10 nm), even if the rate of dissolution of the titanium of the surface layer increases, titanium oxide will form and there will not be coloring due to an interference action, therefore there will not be that great a problem.

When the layer of concentration of carbon at the titanium surface exceeds tens of nm, however, coloring occurs due to an interference action. In the present invention, an extremely good relationship is obtained between the average carbon concentration 100 nm from the surface and discoloration, so it is possible to strikingly improve the discoloration resistance by reducing the average carbon concentration in the range up to 100 nm from the surface to not more than 14 at %. In addition to this, by forming a relatively thick surface oxide film, it is possible to further strikingly improve the discoloration resistance.

The thickness of the oxide film having such a characteristic has to be at least 12 nm. If less than 12 nm, it is not possible to obtain a sufficient protective function. When the thickness of the oxide film is over 40 nm, however, the stress acting on the oxide film increases and the protective function falls even with the occurrence of partial cracks, so the thickness of the oxide film has to be reduced to not more than 40 nm. The most desirable thickness of the oxide film is in the range of 20 to 30 nm.

The existence of such penetration of carbon to the titanium surface can be measured using an Auger electron spectroscopy. That is, it is possible to perform Auger analysis a distance of for example 5 nm or 10 nm from the titanium surface, measure the concentration at least to a depth of at least 100 nm, and use the average value of the same to find the average carbon concentration.

The discoloration of titanium is promoted by the presence of carbon, but even when carbon bonds with titanium to form titanium carbides, discoloration of the titanium is promoted. Such titanium carbides are in many cases TiC, but while smaller in quantity than TiC, there are also carbides like $Ti_2C$ or Ti(CxNl-x) where the concentration of titanium in the carbide is high and carbides containing nitrogen. TiC, however, is the most prevalent carbide in terms of quantity. By reducing the amount of TiC present, it is possible to also reduce the amount of presence of other titanium carbides and titanium carbonitrides. To obtain a quantitative grasp of this, as defined in the above (2), the ratio (X1/X2) of the (200) peak intensity X1 of TiC to the (110) peak intensity X2 of titanium in X-ray diffraction of the surface is made not more than 0.18.

Figure 2:
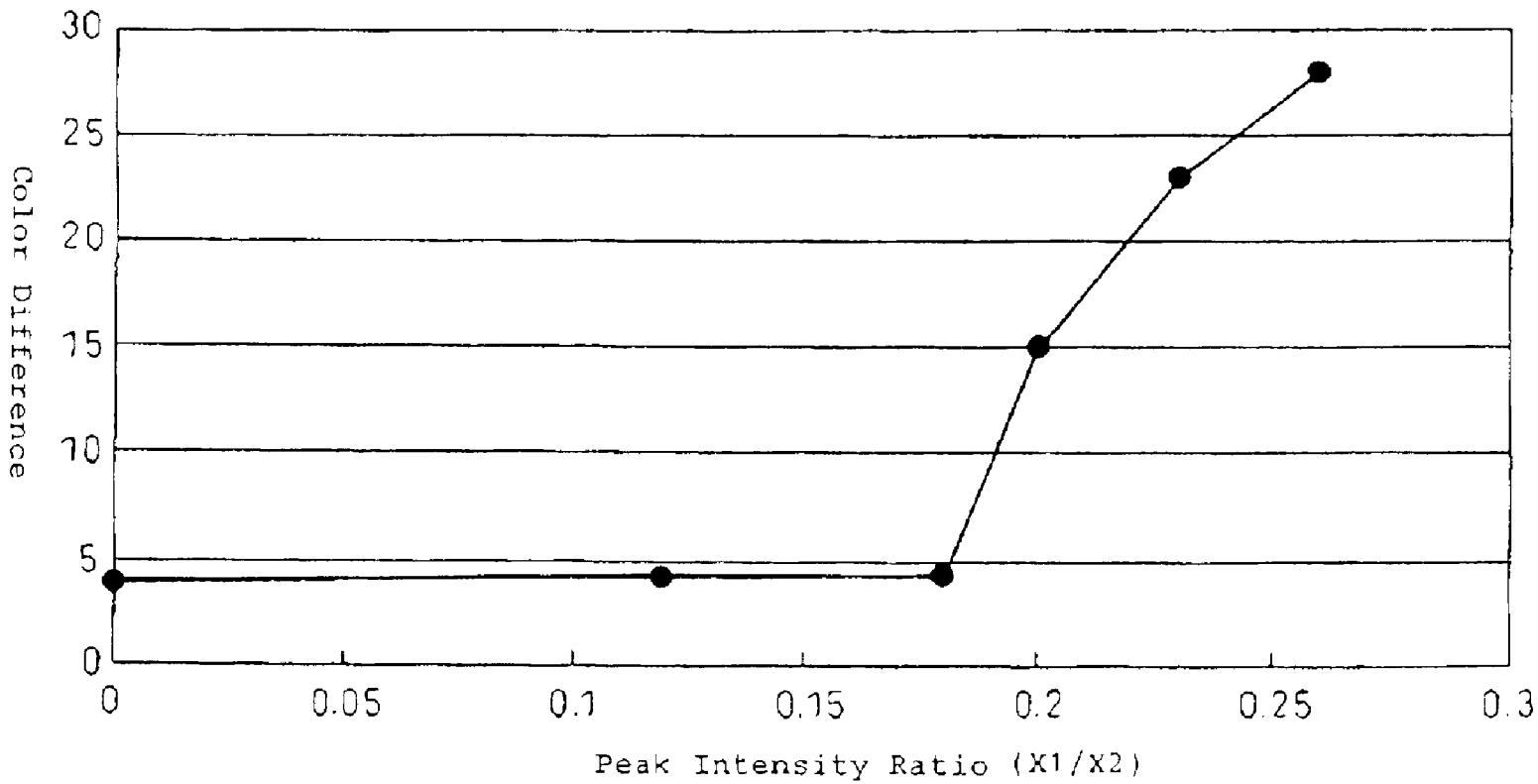
FIG. 2 is a graph of the effect of a ratio (X1/X2) of a (200) peak intensity X1 of TiC to a (110) peak intensity X2 of the titanium on the color difference.

FIG. 2 shows the relationship between the ratio (X1/X2) between the (200) x-ray peak intensity (X1) of the TiC of the titanium surface and the (110) peak intensity (X2) of metal titanium using a thin-film X-ray diffraction system giving information from the titanium surface and the color difference before and after a discoloration promotion test in the laboratory. It was learned that the value of the color difference increases, that is, discoloration is promoted, if the ratio exceeds 0.18 in the presence of TiC.

X-ray diffraction measurement was performed using a RINT1500 made by Rigaku Corporation. The measurement was performed using a copper tube (tube voltage 50 kv, tube current 150 mA) and thin-film attachment under conditions of an incidence angle to the sample surface of 0.5 degree. The divergent slit, scattering slit, and receiving slit of the wide angle goniometer used were 0.40 mm, 8.00 mm, and 5.00 mm. Further, a monochrometer was used. The receiving slit of the monochrometer was made 0.60 mm. The test piece was rotated in plane at a rotational speed of 50 rpm, and the measurement conducted under conditions of a scan speed of 2 degrees per minute.

In this way, it becomes possible to greatly improve the discoloration resistance of titanium by reducing the amount of precipitation of titanium carbides at the titanium surface.

The titanium carbides at the titanium surface can be identified by observation of the surface of a test sample from the sectional direction through a transmission electron microscope. In this case, however, it is not necessarily easy to throw light on the quantitative relationship between the presence of any discoloration and the amount and size of precipitation of titanium carbides—due in part to the fact that the observed region is limited to a local region. Therefore, in the present invention, a technique for measuring the surface area of a relatively broad area such as X-ray measurement is employed. When using a transmission electron microscope to observe a considerable area of a titanium surface, of course superior discoloration resistance is exhibited if no precipitation of titanium carbides is observed at all.

As the form by which titanium is used in an atmospheric environment, a titanium sheet or strip is common. In the above (4), a process of production giving titanium of this form discoloration resistance is disclosed. Normally, titanium sheet and strip used for outdoor applications are cold rolled to a predetermined thickness by cold rolling and then annealed in a temperature region of from 650° C. to near 850° C. to soften the material to enable various types of processing. Titanium sheet and strip produced through such a production process sometimes suffer from greater discoloration of the titanium due to penetration of carbon into the titanium surface arising due to cold rolling oil remaining on the titanium surface.

In such a case, it is possible to greatly improve the discoloration resistance of the titanium by mechanical or chemically removing regions of concentration of carbon and regions of precipitation of titanium carbides, titanium carbonitrides, and titanium nitrides near the titanium surface.

As the mechanical removal method, it is possible to adopt the method of peeling the surface layer using polishing or shot blasting. As the chemical removal method, it is possible to dip the titanium in an acid solution or an alkali solution dissolving the titanium.

With both the mechanical and chemical removal methods, however, since the region penetrated by the carbon is on the micron order (depth of penetration of carbon into titanium surface depends on heat treatment temperature and time), it is essential to remove the titanium to a depth of at least 1 $\mu$m. As a method for efficiently removing titanium, the technique of dipping the titanium in a mixed solution of nitric acid and fluoric acid is particularly preferred.

Further, in the process of producing a cold rolled annealed sheet or strip of discoloration resistant titanium, performing the annealing for softening the material after the cold rolling in a vacuum or an environment in which an inert gas is sealed enables the reduction of the oxidation of the titanium and enables elimination of the subsequent acid pickling step, so this process of production is preferable from the viewpoint of the productivity.

However, if not removing the regions of concentration of carbon or regions of precipitation of titanium carbides, titanium carbonitrides, and titanium nitrides formed on the titanium surface due to the cold D rolling process using a mechanical or chemical technique, regions of high carbon concentration and regions of the above precipitated compounds will be formed on the surface of the final titanium cold rolled sheet or strip and the discoloration of the titanium will sometimes be promoted when using the titanium sheet or strip in an atmospheric environment.

In such a case, as described in the above (5), it is possible to adopt the method of peeling the surface layer using mechanical polishing or shot blasting after the cold rolling. Further, chemical removal can be achieved by dipping the titanium in an acid solution or an alkali solution eluting the titanium. Looking at the depth of penetration of carbon at the titanium surface at the time of cold rolling, compared with the case of removal after annealing shown in the above (4), since there is no penetration by diffusion of carbon at the time of annealing, the depth of penetration is about 0.5 $\mu$m. By mechanically or chemically removing the titanium range in a range of at least 0.5 $\mu$m, it is possible to remarkably improve the discoloration resistance of a titanium sheet or strip annealed in a vacuum or in an inert gas.

The above (6) relates to the above (5). It has as its object to greatly improve the productivity by performing the degreasing and improvement of the discoloration resistance for cold rolled titanium sheet or strip simultaneously by a single step. Degreasing is often performed by dipping in an alkali solution or spraying an alkali solution. However, just dipping in an alkali solution or spraying of an alkali solution is not enough to cause the titanium surface to dissolve to improve the discoloration resistance.

As shown in the above (6), by electrolytically cleaning the surface in a pH 11 to 15 alkali solution, it is possible to cause the desired degreasing and dissolution of the titanium surface. If the pH is less than 11, the $TiO_2$ present on the titanium surface stably remains, so it is not possible to efficiently cause dissolution of the titanium surface. Further, if the pH is 15 or more, it is possible to effectively cause the elusion of the titanium, but use of a strong alkali solution is not preferred in operation and the titanium itself dissolves at a considerable speed with just dipping in a solution, so a pH of 15 was made the upper limit.

The electrolysis conditions are preferably a change is in polarity from (+) to (−) or from (−) to (+) since the organic matter is removed when the titanium becomes a (−) polarity and the dissolution reaction of titanium is promoted when the titanium becomes a (+) polarity.

Regarding the current density, if the current density is not at least 0.05 A/cm$^2$, it is not possible to remove the deposited organic matter and cause a dissolution reaction of the titanium. Further, regarding the electrolysis time, at least 5 seconds are required, If the current density is made high, since generally the required amount of electricity is determined by the current density x time, the required time becomes smaller, but in the case of electrolytic cleaning as explained above, a considerable percentage of the current is consumed at the anode for generation of oxygen and at the cathode for generation of hydrogen, so even if the current density is made high, at least 5 seconds are required as the electrolysis time. Regarding the current density, if over 5 A/cm$^2$, the solution generates remarkable heat and problems arise in operation, so 5 A/cm$^2$ is made the upper limit of the electrolytic current density.

Titanium can be used to produce various types of colored materials utilizing interference colors obtained by changing the thickness of the titanium oxides on the titanium surface. Such colored titanium materials feature the superior corrosion resistance of titanium and can give an aesthetic appearance, so is used as wall paneling or roofing materials where corrosion resistance and aesthetic appearance are required. A colored titanium material is produced by a method such as atmospheric oxidation or anodic oxidation in an aqueous solution. The above (3) of the present invention and the above (7) of the process of production of the same relate to a colored titanium material produced by an oxidation process or anodic oxidation in an alkali aqueous solution or acidic solution.

A colored titanium material is formed with a layer of titanium oxide on the titanium surface, so is believed to be superior in discoloration resistance in the case of use in an atmospheric environment compared with pristine titanium. However, such colored titanium materials believed superior in discoloration resistance also sometimes discolor depending on the usage environment. This discoloration of the colored titanium is promoted by the regions of concentration of carbon or the precipitation of titanium carbides, titanium carbonitrides, and titanium nitrides present at the underlying titanium oxide layer in the same way as the case of pristine titanium.

In colored titanium materials, normally the color is brought out using an interference action, so the thickness of the oxide film ranges from several 10 nm to several 100 nm. As explained above, this is small compared with the distance of penetration of carbon at the titanium surface (on the micron order). Therefore, when producing a colored titanium material using as a starting material titanium with concentrated carbon or precipitated titanium carbides, titanium carbonitrides, and titanium oxide on its surface, regions of concentration of carbon or regions of precipitation of titanium carbides remain at the underlying titanium oxide layer (metal titanium side), so the discoloration resistance of the colored titanium material is degraded. Therefore, it is possible to improve the discoloration resistance of a colored titanium material by removing the regions of concentration of carbon or the titanium carbides, titanium carbonitrides, and titanium nitrides present at the underlying portion of the titanium oxide.

That is, it is possible to obtain colored titanium superior in discoloration resistance by using as a starting material titanium or titanium produced by the process of production shown in (4) to (6) and dipping this in an electrolyte solution and anodically electrolyzing it or heating it in the atmosphere.

Further, the titanium produced in accordance with the above (4) to (7) can be further improved in discoloration resistance by steam treatment at least once. The mechanism for improvement of the discoloration resistance due to steam treatment is not sufficiently elucidated, but it is guessed that the defects in the passive state film at the titanium surface are repaired. Water molecules are believed to be closely involved in this repair.

Therefore, as the temperature of the steam treatment, a temperature of at least 100° C. is necessary. If less than 100° C., it is not possible to obtain enough heat energy as required for repair of defects in the passive state film. If the temperature of the steam treatment is over 550° C., however, the oxide film at the titanium surface grows thick and a porous coating results and the protective action drops, so this is not preferred.

Note that for the treatment time, the reaction is believed to proceed considerably fast at the above temperature range. It is possible to hold the titanium material in steam for at least 10 seconds or spray the titanium material with steam raised to the above temperature so as to bring the titanium into contact with the steam and greatly increase the discoloration resistance. To obtain stable results, however, it is preferable to hold the material or spray it for several minutes. Note that there is no deterioration in the discoloration resistance with steam treatment for more than 60 minutes, but the effect of improvement of the discoloration resistance becomes substantially saturated at that point, so 60 minutes was made the upper limit.

Note that the pre-treatment for the steam treatment is not particularly limited, but if organic contaminant remains on the titanium surface, the effect of the steam treatment will fall, so it is necessary to treat the titanium surface using a suitable solvent or weak alkali degreasing agent. This pre-treatment, however, is not anything special and may be performed by a usual degreasing step. Further, tap water etc. may be used for the water used for the steam treatment. Depending on the difference in the ingredients contained in the water, however, there might be a detrimental effect on the test results, so when using fresh water etc. as it is, it might sometimes be better to conduct preliminary tests etc. and use tap water when good test results cannot be obtained.

EXAMPLES

Table 1 shows the results of measurement of the color difference before and after a dipping test (effect of acid rain) when dipping titanium of different average carbon concentrations in a range to 100 nm from the outermost surface in a pH 3 sulfuric acid solution at 60° C. for 2 weeks and an investigation of the effect of the carbon concentration on the discoloration. Note that the color difference was measured by use of the following formula from the differences $\Delta L^*$, $\Delta a^*$, and $\Delta b^*$ before and after measurement of the luminance $L^*$ and chromaticities $a^*$ and $b^*$ found in accordance with JIS Z 8730:

$$\text{Color difference } \Delta Eab^* = [(\Delta L^*)^2 + (\Delta a^*)^2 + (\Delta b^*)^2]^{1/2}$$

As shown in Table 1, these titanium materials include flat surface cold rolled materials and roughened shot blasted materials etc. In all titanium materials of these surface finishings, however, it was learned that by making the average carbon concentration at the surface not more than 14 at % in accordance with the process of the present invention and making the thickness of the oxide film at the outermost surface a range of 12 to 40 nm, a superior discoloration resistance of a color difference before and after the test of not more than about 5 is exhibited.

The surface carbon concentration was measured using an Auger electron spectroscopy. In this measurement, the results include the solid solution carbon and carbon in the titanium carbides. It is not possible to separate the solid solution carbon and carbon included in the carbides. That is, the carbon concentration of the titanium surface shown in Table 1 ends up including the solid solution carbon and the carbon included in the carbides.

Table 2 shows the results of investigation of the effects of TiC on the discoloration of titanium by a method similar to the above for titanium of different amounts of TiC on the surface using a X-ray diffraction system. As shown in Table 2, for the amount of TiC present, use was made of the integrated intensity of the signal believed to be due to the TiC in the X-ray diffraction measurement. The peak of the X-rays believed to be due to the TiC differs somewhat from the pure peak position in X-ray diffraction measurement. In the present invention, the compound described as TiC may possibly have changed in lattice constant due to some solid solution of nitrogen in the compound. It is learned that the titanium of the present invention having a signal intensity due to the TiC of zero or below the detection limit exhibits an extremely superior discoloration resistance of a color difference of about 5.

Table 3 shows the results of measurement of the color difference before and after a discoloration promotion test when annealing a titanium strip cold rolled to a thickness of 0.6 mm in an argon gas, then suitably thereafter removing the surface layer of the titanium strip by chemical dissolution and mechanical removal to the indicated depth and testing that material in a pH 3 sulfuric acid solution.

As shown in Table 3, it was learned that a titanium strip from which several μm of its surface layer were removed by a chemical and mechanical method exhibited a value of the color difference of not more than about 5, that is, an extremely superior discoloration resistance, compared with a titanium material from which it was not removed.

Table 4 shows the results of measurement of the color difference before and after a dipping test when dipping in a pH 3 sulfuric acid solution a titanium strip cold rolled to a thickness of 0.4 mm in a nitric and fluoric acid solution so as to dissolve several μm of the titanium surface or when dipping a titanium strip from which several μm of the surface layer has been removed by mechanical polishing. As shown in Table 4, it is learned that such a titanium strip exhibits an extremely superior discoloration resistance.

Table 5 shows the results of measurement of the color difference before and after a dipping test when electrolytically cleaning a titanium strip cold rolled to a thickness of 0.5 mm in a pH 9 to 15 alkali solution under various current density conditions, then suitably thereafter annealing it in argon gas and vacuum at 640° C. for 8 hours, then performing the test in a pH 3 60° C. sulfuric acid solution for 14 days. As shown in Table 5, it was learned that samples electrolytically cleaned in a pH 11 to 15 solution in accordance with the process of the present invention exhibit a superior discoloration resistance.

Table 6 shows the results of measurement by Auger spectroanalysis of the average carbon concentration in a range to 100 nm from the outermost surface before treatment of the colored titanium produced by anodic oxidation in a 1% phosphoric acid solution and by heating in the atmosphere and the results of evaluation of the discoloration resistance of the colored titanium material (gold and blue).

As shown in Table 6, it is learned that colored titanium produced using as a material titanium reduced in average carbon concentration to not more than 10 at % according to the process of the present invention exhibits a superior discoloration resistance in a discoloration promotion test using a pH 3 sulfuric acid solution.

Further, in Tables 3 to 6, steam treated samples exhibited a more superior discoloration resistance compared with untreated samples.

TABLE 1

| | Average carbon concentration at titanium surface (*) | Thickness of surface oxide layer | Color difference (before and after discoloration test) |
|---|---|---|---|
| Invention 1 | 3.5 (at %) | 12 (nm) | 4 |
| Invention 2 | 5.5 | 20 | 4.5 |
| Invention 3 | 7.5 | 37 | 4.8 |
| Invention 4 | 9 | 22 | 5 |
| Invention 5 | 13 | 13 | 4.9 |
| Comp. Ex. 1 | 15 | 6 | 13 |
| Comp. Ex. 2 | 24 | 5 | 22 |
| Comp. Ex. 3 | 30 | 7 | 25 |
| Comp. Ex. 4 | 37 | 9 | 27 |
| Comp. Ex. 5 | 7.5 | 5 | 15.8 |

(*) 100 nm from outermost surface

TABLE 2

| | Peak intensity ratio (X1/X2) | Thickness of surface oxide film | Color difference (before and after discoloration test) |
|---|---|---|---|
| Invention 1 | 0 | 12 | 3.4 |
| Invention 2 | 0.1 | 20 | 4.2 |
| Invention 3 | 0.16 | 37 | 4.3 |
| Comp. Ex. 1 | 0.14 | 5 | 11 |
| Comp. Ex. 2 | 0.2 | 6 | 12 |
| Comp. Ex. 3 | 0.22 | 4 | 20 |
| Comp. Ex. 4 | 0.24 | 3 | 22 |
| Comp. Ex. 5 | 0.26 | 5 | 28 |

TABLE 3

| | Sheet thickness (mm) | Method of removal | Depth of removal (μm) | Existence and conditions of steam treatment | Color difference |
|---|---|---|---|---|---|
| Invention 1 | 0.5 | Polishing | 1.5 | No | 5.0 |
| Invention 2 | 0.6 | 1 minute dipping in 50° C. nitric acid + fluoric acid solution | 5.0 | No | 4.6 |
| Invention 3 | 0.4 | 1.5 minute dipping in 50° C. nitric acid + fluoric acid solution | 7.0 | No | 4.9 |
| Invention 4 | 0.4 | 1.5 minute dipping in 50° C. nitric acid + fluoric acid solution | 7.0 | Yes (120° C., 10 minutes) | 1.8 |
| Comp. Ex. 1 | 0.7 | Polishing | 0.1 | No | 18.5 |
| Comp. Ex. 2 | 0.5 | 10 second dipping in 50° C. nitric acid + fluoric acid solution | 0.2 | No | 15.8 |

TABLE 4

| | Sheet thickness (mm) | Method of removal | Depth of removal (μm) | Existence and conditions of steam treatment | Color difference |
|---|---|---|---|---|---|
| Invention 1 | 0.6 | Polishing | 0.7 | No | 4.5 |
| Invention 2 | 0.5 | 30 second dipping in 50° C. nitric acid + fluoric acid solution | 2.0 | No | 3.9 |
| Invention 3 | 0.6 | Polishing | 0.7 | Yes (350° C., 2 minutes) | 1.6 |

TABLE 4-continued

| | Sheet thickness (mm) | Method of removal | Depth of removal (μm) | Existence and conditions of steam treatment | Color difference |
|---|---|---|---|---|---|
| Comp. Ex. 1 | 0.4 | Polishing | 0.1 | No | 15.8 |
| Comp. Ex. 2 | 0.6 | 15 second dipping in 50° C. nitric acid + fluoric acid solution | 0.2 | No | 16.9 |

TABLE 5

| | Sheet thickness (mm) | Solution composition and pH of solution | Electrolysis conditions | Existence and conditions of steam treatment | Color difference |
|---|---|---|---|---|---|
| Invention 1 | 0.5 | pH 11 NaOH aqueous solution | Electrolysis at polarity (−) -> (+), 2 A/cm$^2$ for 10 seconds each | No | 4.6 |
| Invention 2 | 0.6 | pH 12 NaOH aqueous solution | Electrolysis at polarity (−) -> (+), 5 A/cm$^2$ for 5 seconds each | No | 4.5 |
| Invention 3 | 0.7 | pH 14 NaOH aqueous solution | Electrolysis at polarity (−) -> (+), 0.05 A/cm$^2$ for 5 seconds each | No | 4.7 |
| Invention 4 | 0.4 | pH 15 NaOH aqueous solution | Eleotrolysis at polarity (+) -> (1), 5 A/cm$^2$ for 5 seconds each | No | 5.3 |
| Invention 5 | 0.5 | pH 11 NaOH aqueous solution | Electrolysis at polarity (−) -> (+), 2 A/cm$^2$ for 10 seconds each | Yes (120° C., 10 minutes) | 2.1 |
| Comp. Ex. 1 | 0.6 | pH 9 NaOH aqueous solution | Electrolysis at polarity (−) -> (+), 5 A/cm$^2$ for 5 seconds each | No | 22.5 |
| Comp. Ex. 2 | 0.5 | pH 10 NaOH aqueous solution | Electrolysis at polarity (−) -> (+), 2 A/cm$^2$ for 10 seconds each | No | 19.6 |

TABLE 6

| | Sheet thickness (mm) | Carbon concentration before treatment (at %) | Electrolysis condition | Existence and conditions of steam treatment | Color | Color difference |
|---|---|---|---|---|---|---|
| Invention 1 | 0.6 | 7.5 | Anodic oxidation in 1% phosphoric acid solution | No | Gold | 4.6 |
| Invention 2 | 0.5 | 5.5 | Anodic oxidation in 1% phosphoric acid solution | No | Blue | 3.5 |
| Invention 3 | 0.7 | 6.2 | Heating in atmosphere | No | Gold | 5.2 |
| Invention 4 | 0.4 | 8.0 | Heating in atmosphere | No | Blue | 3.2 |
| Invention 5 | 0.5 | 5.5 | Anodic oxidation in 1% phosphoric acid solution | Yes (450° C., 2 minutes) | Blue | 1.6 |
| Invention 6 | 0.7 | 6.2 | Heating in atmosphere | Yes (120° C., 10 minutes) | Gold | 1.8 |
| Comp. Ex. 1 | 0.7 | 23.5 | Anodic oxidation in 1% phosphoric acid solution | No | Gold | 28.5 |
| Comp. Ex. 2 | 0.6 | 32.5 | Heating in atmosphere | No | Blue | 17.5 |

INDUSTRIAL APPLICABILITY

According to the present invention, titanium suppressed in increased concentration of carbon at the titanium surface or precipitation of titanium carbides, titanium carbonitrides, and titanium nitrides has an extremely superior discoloration resistance and is particularly effective for applications in outdoor environments such as roofing or wall paneling.

What is claimed is:

1. Titanium resistant to discoloration in an atmospheric environment characterized by having an average carbon concentration in a range to a depth of 100 nm from an outermost surface of not more than 14 at % and having an oxide film of a thickness of 12 to 40 nm at the outermost surface.

2. Titanium as get forth in claim 1, characterized by having an oxide film causing an interference color at its surface.

3. Titanium resistant to discoloration in an atmospheric environment characterized in that, in x-ray diffraction of its surface, a ratio (X1/X2) of a (200) peak intensity X1 of TiC to a (110) peak intensity X2 of titanium is not more than 0.18 and by having an oxide film of a thickness of 12 to 40 nm at its outermost surface.

4. Titanium as set forth in claim 3, characterized by having an oxide film causing an interference color at its surface.

5. A process of production of titanium resistant to discoloration in an atmospheric environment characterized by cold rolling the titanium, then annealing it in vacuum or an inert gas, then suitably thereafter mechanically or chemically removing at least 1 μm of the titanium surface.

6. A process as set forth in claim 5, characterized by further performing, as after-treatment, treatment for anodically oxidizing the surface in an electrolyte solution or heating it to oxidize in the atmosphere.

7. A process as set forth in claim 5 or 6, characterized by further performing steam treatment for bringing the surface into contact with 100 to 550° C. steam for 10 seconds to 60 minutes at least once.

8. A process as set forth in claim 7, characterized in that said steam treatment is performed as a final step in the production process.

9. A process of production of titanium resistant to discoloration in an atmospheric environment characterized by cold rolling the titanium, then mechanically or chemically removing at least 0.5 μm of the surface, then suitably thereafter annealing in vacuum or an inert gas.

10. A process as set forth in claim 9, characterized by further performing, as after-treatment, treatment for anodically oxidizing the surface in an electrolyte solution or heating it to oxidize in the atmosphere.

11. A process as set forth in claim 9 or 10, characterized by further performing steam treatment for bringing the surface into contact with 100 to 550° C. Steam for 10 seconds to 60 minutes at least once.

12. A process as set forth in claim 11, characterized in that said steam treatment is performed as a final step in the production process.

13. A process of production of titanium resistant to discoloration in an atmospheric environment characterized by cold rolling the titanium, then electrolytically cleaning it in a pH 11 to 15 alkali solution in a range of current density of 0.05 to 5A/cm$^2$, then suitably thereafter annealing in vacuum or an inert gas.

14. A process as set forth in claim 13, characterized by further performing, as after-treatment, treatment for anodically oxidizing the surface in an electrolyte solution or heating it to oxidize in the atmosphere.

15. A process as set forth in claim 13 or 14, characterized by further performing steam treatment for bringing the surface into contact with 100 to 550° C. steam for 10 seconds to 60 minutes at least once.

16. A process as set forth in claim 15, characterized in that said steam treatment is performed as a final step in the production process.

* * * * *

UNITED STATES PATENT AND TRADEMARK OFFICE

CERTIFICATE OF CORRECTION

PATENT NO. : 6,863,987 B2
DATED : March 8, 2005
INVENTOR(S) : Michio Kaneko et al.

It is certified that error appears in the above-identified patent and that said Letters Patent is hereby corrected as shown below:

Column 5,
Line 59, change “cold D rolling” to -- cold rolling --; and

Column 11,
Line 19, change “Eleotrolysis” to -- Electrolysis --; and
Line 59, change “get” to -- set --; and Column 12,
Line 22, change “19.6” to -- 19.8 --; and Column 13,
Line 7, change “Steam” to -- steam --.

Signed and Sealed this

Twentieth Day of September, 2005

JON W. DUDAS
*Director of the United States Patent and Trademark Office*